US011033100B1

(12) United States Patent
Park

(10) Patent No.: US 11,033,100 B1
(45) Date of Patent: Jun. 15, 2021

(54) VERSATILE SHOE CLEANING DEVICE

(71) Applicant: Hyun C. Park, Seal Beach, CA (US)

(72) Inventor: Hyun C. Park, Seal Beach, CA (US)

(73) Assignees: Hyun C. Park, Seal Beach, CA (US); Joseph H. Park, Anchorage, AK (US); Jeniffer Kang, Cerritos, CA (US)

( * ) Notice: Subject to any disclaimer, the term of this patent is extended or adjusted under 35 U.S.C. 154(b) by 0 days.

(21) Appl. No.: 17/037,076

(22) Filed: Sep. 29, 2020

(51) Int. Cl.

| | |
|---|---|
| ***A46B 13/04*** | (2006.01) |
| ***A47L 23/02*** | (2006.01) |
| ***A46B 13/00*** | (2006.01) |
| ***A46B 13/02*** | (2006.01) |

(52) U.S. Cl.
CPC ..... *A46B 13/04* (2013.01); *A46B 13/001* (2013.01); *A46B 13/008* (2013.01); *A46B 13/02* (2013.01); *A47L 23/02* (2013.01); *A46B 2200/306* (2013.01)

(58) Field of Classification Search
CPC ..... A46B 7/04; A46B 7/042; A46B 7/044; A46B 7/046; A46B 7/048; A46B 7/10; A46B 13/00; A46B 13/001; A46B 13/008; A46B 13/02; A46B 13/04
USPC .. 15/4, 23, 24, 28, 29, 97.1, 97.2, 179, 181, 15/230, 230.14, 230.18, 230.19
See application file for complete search history.

(56) References Cited

U.S. PATENT DOCUMENTS

| | | | | | |
|---|---|---|---|---|---|
| 1,775,186 | A * | 9/1930 | Bartling | A47L 11/4041 | 15/97.1 |
| 3,307,211 | A * | 3/1967 | Gaines | A47L 23/06 | 15/4 |
| 3,500,490 | A * | 3/1970 | Teren | A47L 17/00 | 15/97.1 |
| 3,965,521 | A * | 6/1976 | Wardell | B05C 17/02 | 15/114 |
| 5,701,625 | A * | 12/1997 | Siman | A46B 13/02 | 15/21.1 |
| 5,950,268 | A * | 9/1999 | Murphy | A46B 13/02 | 15/28 |
| 2008/0022484 | A1* | 1/2008 | Caruso | B25F 5/02 | 15/344 |
| 2009/0255071 | A1* | 10/2009 | Jones | A46B 7/10 | 15/29 |

FOREIGN PATENT DOCUMENTS

| | | | |
|---|---|---|---|
| DE | 2944870 | * | 5/1981 |
| WO | 2005/070277 | * | 8/2005 |

* cited by examiner

*Primary Examiner* — Mark Spisich
(74) *Attorney, Agent, or Firm* — Heedong Chae; Lucem, PC

(57) ABSTRACT

A versatile cleaning device including a top cleaning assembly that includes a top cleaning means and a mount; a first shaft constructed to be fixedly or removably coupled to the top cleaning assembly; a side cleaning assembly that includes a side cleaning means, a body, and a first shaft receiving hole; and a second shaft constructed to be fixedly or removably coupled to the side cleaning assembly. The second shaft is constructed to be attached to the handle for electrically rotating the versatile cleaning device.

20 Claims, 17 Drawing Sheets

VERSATILE SHOE CLEANING DEVICE

FIELD OF THE INVENTION

The present invention relates to a versatile cleaning device having a top cleaning assembly and a side cleaning assembly, and more particularly, a versatile cleaning device for rotatably cleaning a wide variety of articles and surfaces, the versatile cleaning device having a top cleaning assembly and a side cleaning assembly.

BACKGROUND OF THE INVENTION

Cleaning devices come in at wildly varying degrees of shapes, sizes, user friendliness, convenience and cost. Many of these cleaning devices are specialized to clean and/or polish a certain subset of articles. If a user desires to clean and/or polish different kinds of articles or surfaces, the user might be required to carry multiple devices, which may prove to be unwieldy to carry around if the user needs to bring a number of such cleaning devices with them. Furthermore, the user may need to sort out which devices to use and familiarize themselves with the intricacies of each individual device, all of which may be unnecessarily burdensome to the user.

While there has been a trend towards engineering devices to be smaller. Many times such devices are highly specialized for one role. For a particular job, the user may be forced to carry a number of cleaning devices and cleaning implements between locations. To permit such items to be carried with the specialized cleaning device, the user may be required to have an additional carrying bag, which adds to burden when the user is forced to sort through the bag to find and setup the right device for the cleaning job. This solution adds more hindrance to a user without solving the need of having a versatile cleaning device that is constructed to clean a variety of articles and surfaces.

Therefore, to solve the above problems and provide individuals with a convenient way to clean various articles and surfaces of different shapes, sizes, materials, and configurations, there is a need for a convenient versatile cleaning device to provide multiple types of cleaning tools (brushes, cleaning fabric, and the like) in a relatively compact size and in a convenient adjustable shape to provide flexibility and increase the efficiency to the user when the versatile cleaning device is used. This invention is directed to solve these problems and satisfy the long-felt need.

SUMMARY OF THE INVENTION

The present invention contrives to solve the disadvantages of the prior art. The present invention provides a versatile cleaning device having multiple cleaning assembles capable of cleaning multiple angles of a wide variety of articles and surfaces while constructed to have a relative compact size and configured for convenient use.

The object of the invention is to provide a versatile cleaning device for rotatably cleaning a variety of articles and surfaces by being attached to a handle having an electric motor. The versatile cleaning device includes a top cleaning assembly that includes a top cleaning means and a mount; a first shaft constructed to be fixedly or removably coupled to the top cleaning assembly; a side cleaning assembly that includes a side cleaning means, a body, and a first shaft receiving hole; and a second shaft constructed to be fixedly or removably coupled to the side cleaning assembly. The second shaft is constructed to be attached to the handle for electrically rotating the versatile cleaning device.

Another object of the invention is to provide a versatile cleaning device for rotatably cleaning a variety of articles and surfaces, the versatile cleaning device including a top cleaning assembly that includes a top cleaning means and a mount; a side cleaning assembly that includes a side cleaning means and a body; and a handle that includes an electric motor; and a shaft-receiving hole. The side cleaning assembly is constructed to couple, directly or indirectly, to the handle. The top cleaning assembly is constructed to couple, directly or indirectly, to the side cleaning assembly. Furthermore, the top cleaning assembly is constructed to couple, directly or indirectly, to the handle.

Yet another object of the invention is to provide a versatile cleaning device for rotatably cleaning a variety of articles and surfaces, the versatile cleaning device including a handle that includes an electric motor and a shaft-receiving hole; and a side cleaning assembly. The side cleaning assembly includes a side cleaning means; a body; a side wall between a top and a bottom of the body; an internal reservoir constructed by the side wall to hold cleaning solution; a coupling cap constructed to removably couple with the top of the body to provide access to the internal reservoir; a plurality of holes through the side wall; and an opening means covering the plurality of holes. Furthermore, the side cleaning assembly is constructed to couple, directly or indirectly, to the handle.

The advantages of the present invention are: (1) the versatile cleaning device of the present invention provides multiple modes of cleaning with the ability to interchange different cleaning implements (e.g. brushes, cleaning fabric, and the like) with minimal effort or downtime; (2) the versatile cleaning device is compact in size that allows for easy transport; (3) the versatile cleaning is configured for ease of use; (4) the unique construction of the top cleaning assembly and the side cleaning assembly of the versatile cleaning device provides increased flexibility to the user in terms of its use as well as increasing the user's efficiency due to the ability to clean multiple surfaces at the same time; (5) the number of parts for the versatile cleaning device is optimized to be as few as possible to keep manufacturing costs low without removing the advantages properties of the versatile cleaning device; (6) the handle may be angled to permit the versatile cleaning device to clean and/or polish hard-to-reach places; (7) the versatile cleaning device of the present invention includes the top cleaning assembly that has a groove to further secure and allow the use of various cleaning implements to used interchangeably in a convenient fashion; (8) the versatile cleaning device of the present invention includes the side cleaning assembly has a groove to further secure and allow the use of various cleaning implements interchangeably in a convenient fashion; and (9) the versatile cleaning device of the present invention includes a configuration constructed to store cleaning solutions internally to allow users to have the cleaning solution available when cleaning an article.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1A:
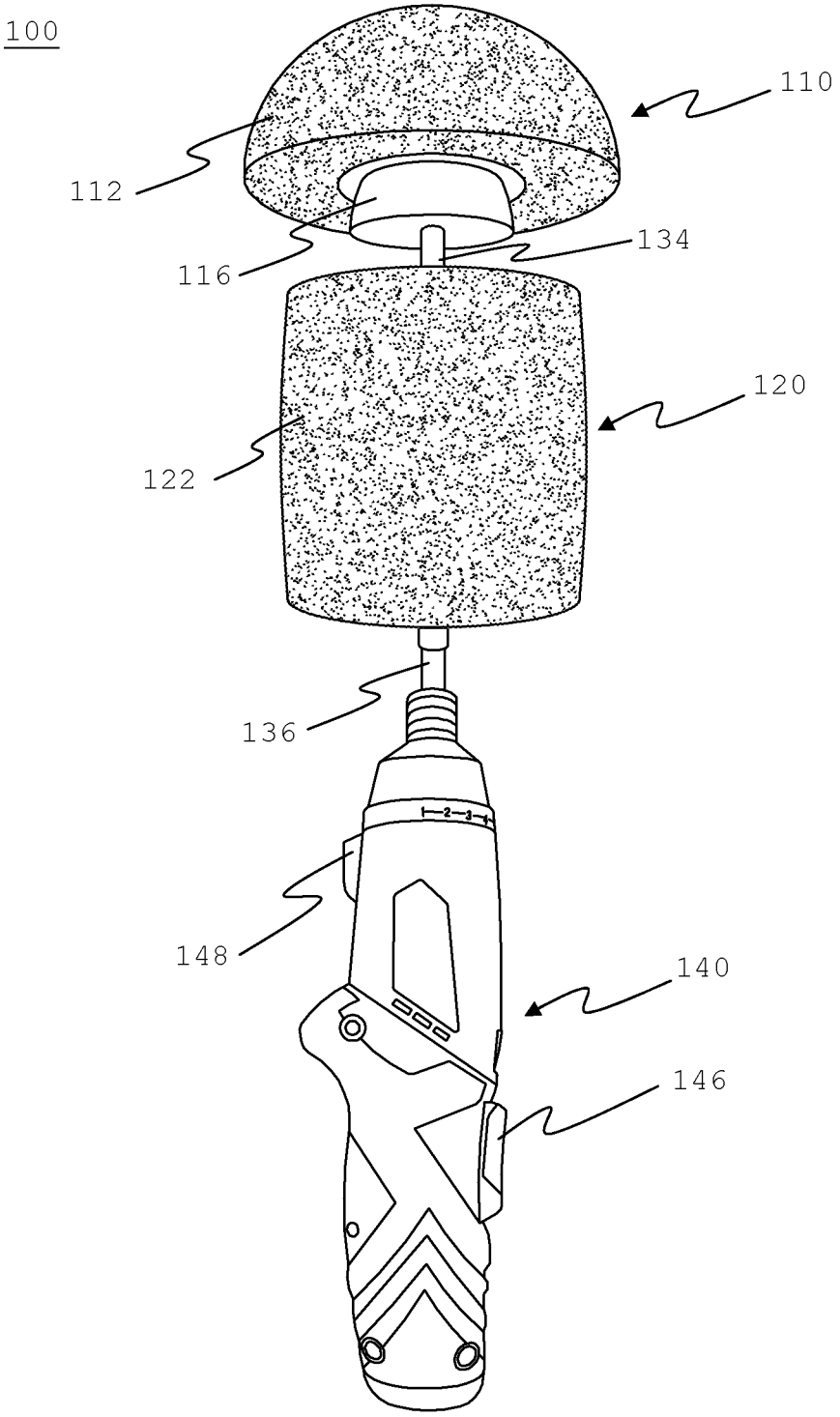
FIGS. 1A-C show perspective views of versatile cleaning devices of the present invention.
Figure 1B:
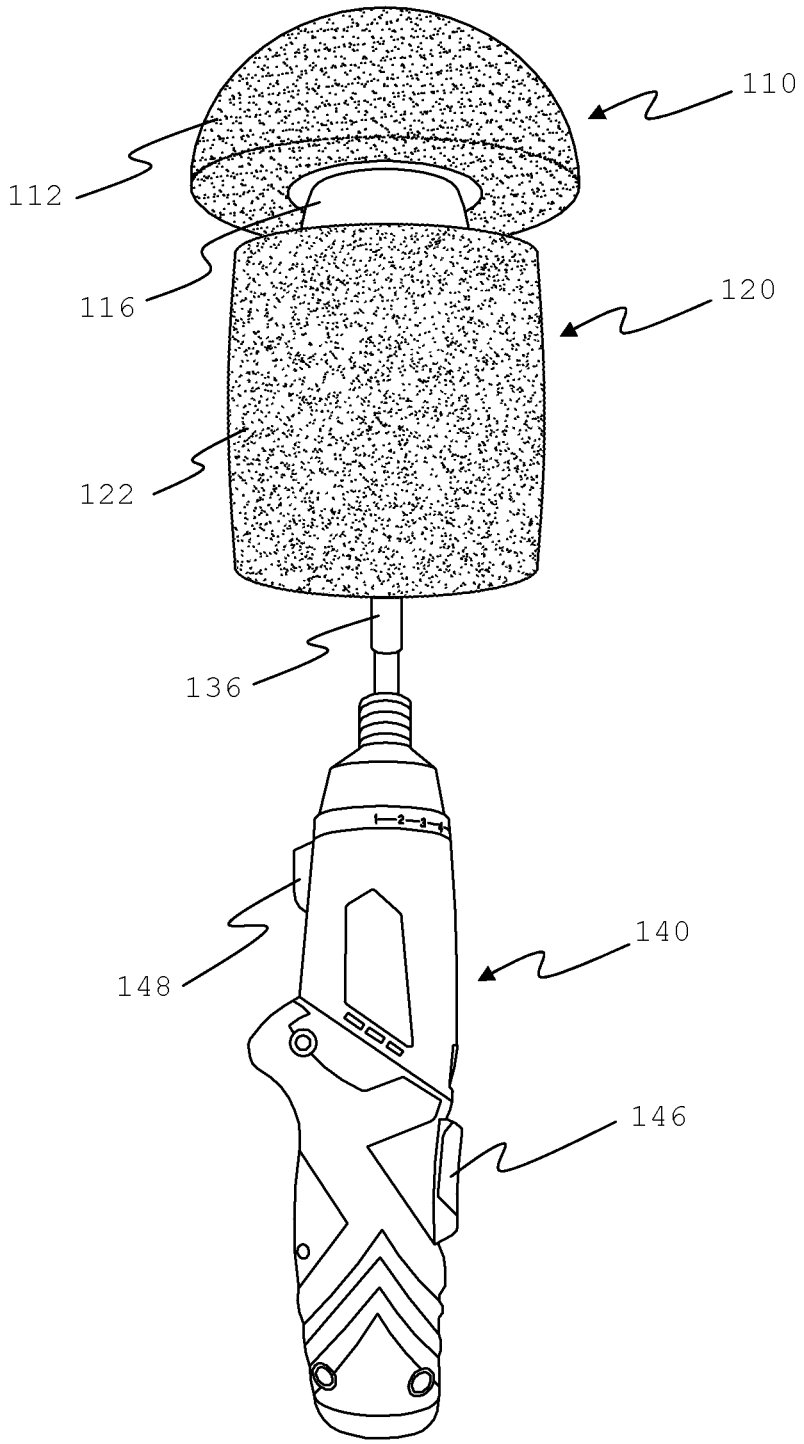

FIG. 1A shows an embodiment of a versatile cleaning device (100) for rotatably cleaning a variety of articles and surfaces by being attached to a handle (140) having an electric motor (142). The versatile cleaning device (100) includes a top cleaning assembly (110) that includes a top cleaning means (112) and a mount (114); a first shaft (134) constructed to be fixedly or removably coupled to the top cleaning assembly (110); a side cleaning assembly (120) that includes a side cleaning means (122), a body (124), and a first shaft-receiving hole (127); and a second shaft (136) constructed to be fixedly or removably coupled to the side cleaning assembly (120). The second shaft (136) is constructed to be attached to the handle (140) such that the top cleaning assembly (110) and the side cleaning assembly (120) rotate when the handle (140) is powered by electricity. To achieve this, the handle (140) includes an electric motor (142), and may include a battery (144) (rechargeable or non-rechargeable) and/or may be configured to draw power from an electrical outlet. Articles that can be cleaned using this embodiment includes shoes and surfaces, the latter of which includes any surface, or surfaces of equipment or devices, that require cleaning, polishing, and/or buffing.

Figure 4:
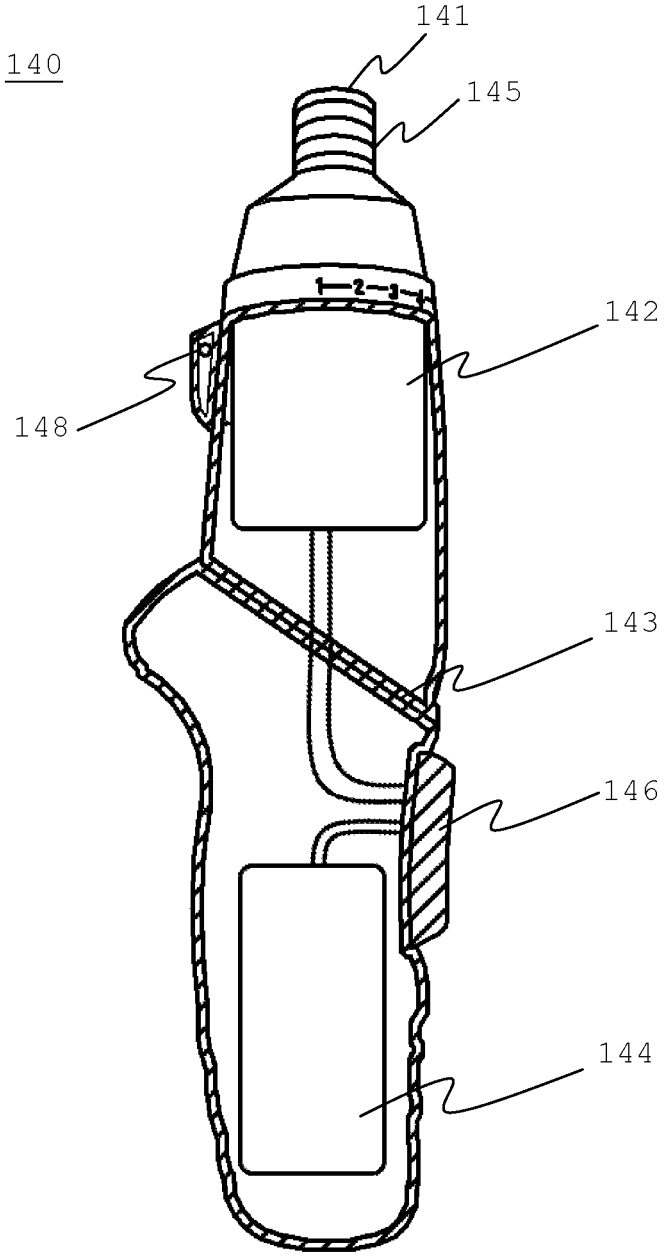
FIG. 4 shows an interior view of a handle.

The handle (140) may be constructed to be either a single segment or multiple segments, the latter of which is shown in FIGS. 1A-C, 2, and 4. According to the latter construction, the handle (140) may adopt different angles about a pivot (143), as shown in FIG. 4, in order to provide additional comfort and/or an enhanced grip for certain angles resulting in a more efficient cleaning of the article or surface. Preferably, the pivot (143) may be part of a rotating and ratcheting mechanism that is adjustable by the user who is able to set the pivot (143) at any number of different angles. Alternatively, the pivot (143) is part of a rotary adjustment mechanism that can be locked or unlocked with a push of a button to ensure that the angle chosen by the user will remain as such during the cleaning process.

Figure 1C:
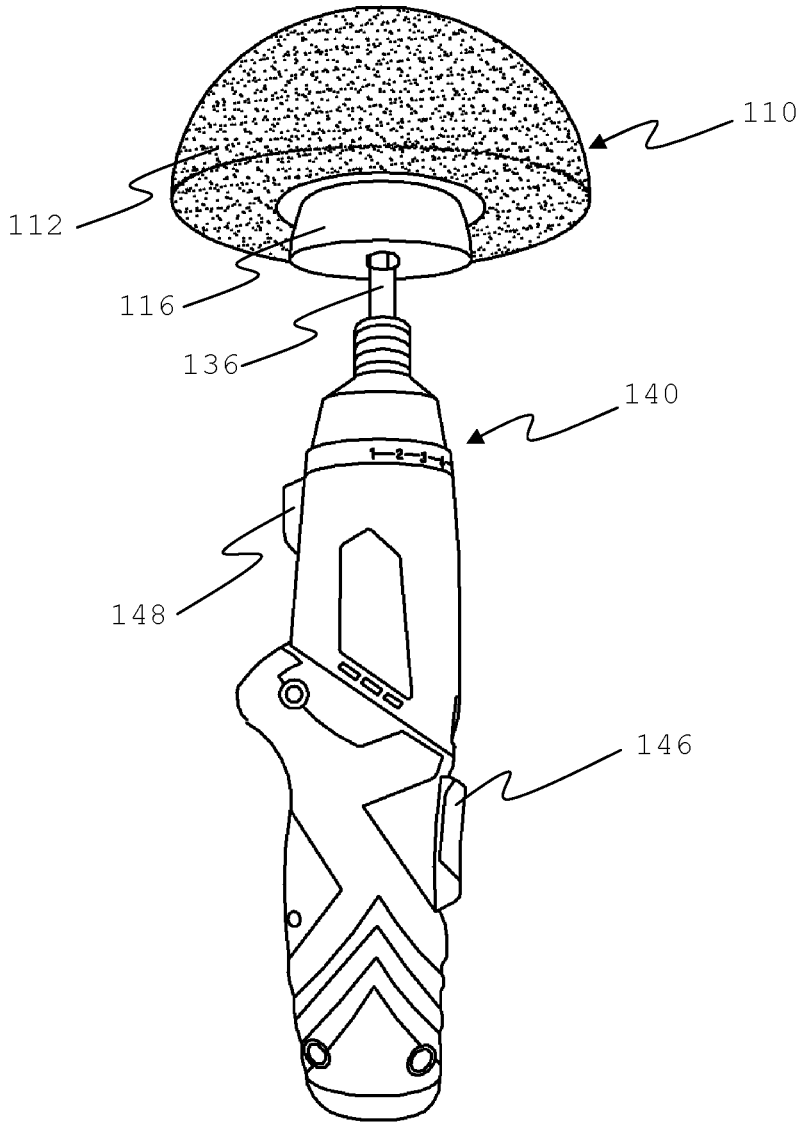
Figure 2:
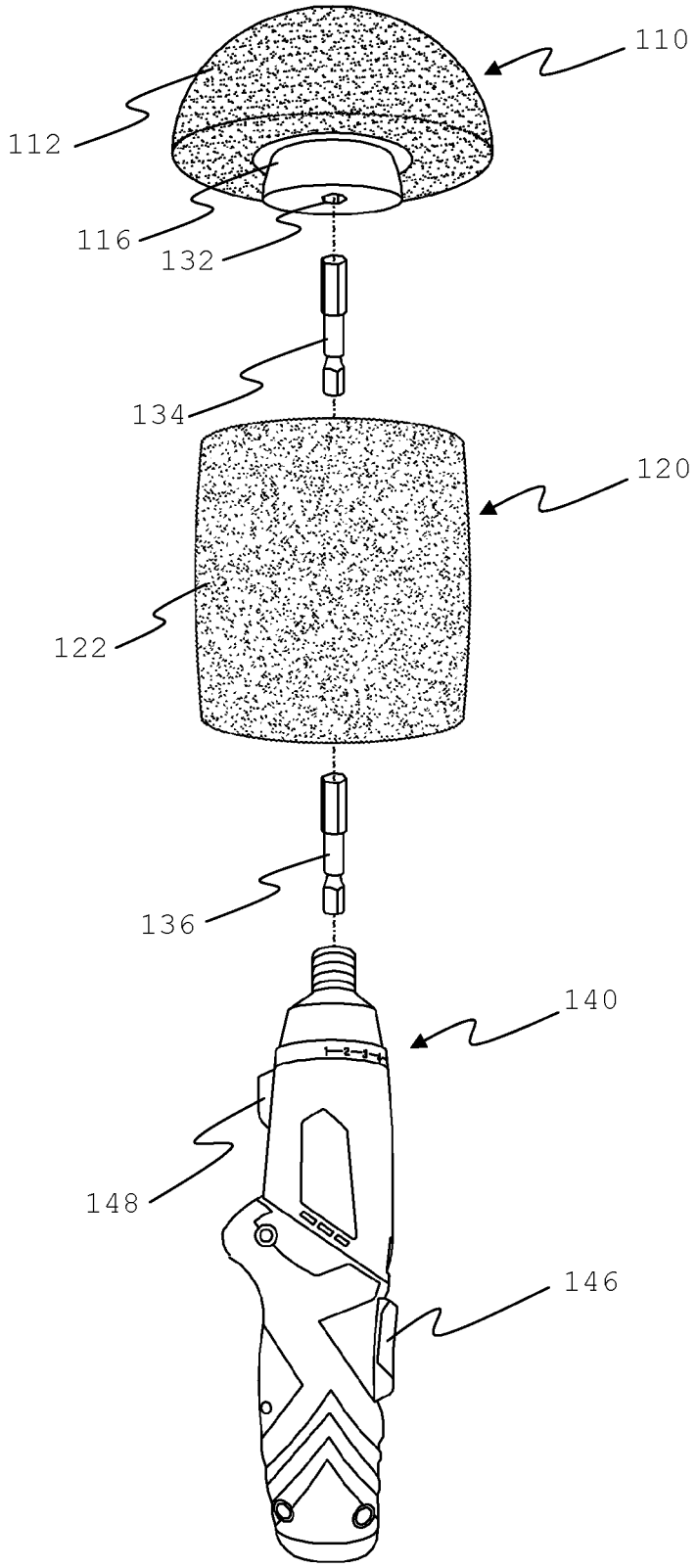
FIG. 2 shows an exploded view of the versatile cleaning device of FIG. 1A.
Figure 3A:
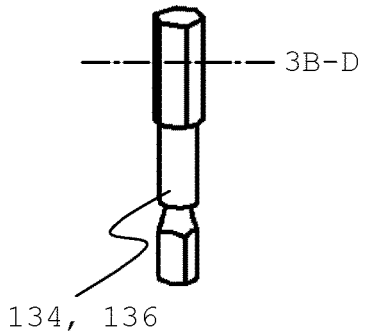
FIGS. 3A-D shows cross-sectional view of a shaft of the versatile cleaning device of FIG. 2.
Figure 3B:
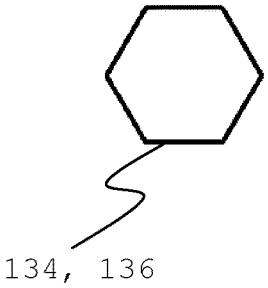
Figure 3C:
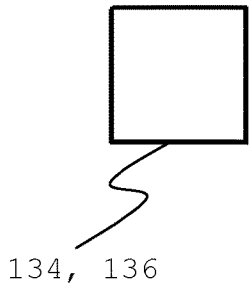
Figure 3D:
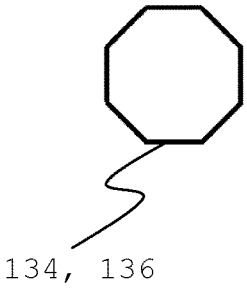

With respect to the first and second shafts (134, 136) shown in FIG. 2, portions of the first and second shafts (134, 136) may be multi-sided. A cross-section of the first shaft (134) and a cross-section of the second shaft (136) can be substantially the same as shown in FIG. 3. For example, as shown, cross-sections of the portions of the first and second shafts (134, 136) may be substantially hexagonal. The first shaft (134) and the second shaft (136) may be the substantially the same in construction but may be arranged differently or the same orientation in practice. With regards to the first shaft (134), the first shaft (134) may be alternatively constructed to be attached to the handle (140) for electrically rotating the versatile cleaning device (100) as shown in FIG. 1C, wherein the top cleaning assembly (110) may directly couple with the handle (140) by the first shaft (134). Furthermore, the first shaft (134) may be constructed to fixedly couple to the top cleaning assembly (110). In this case, the second shaft (136) is removably coupled to the side cleaning assembly (120), and the side cleaning assembly (120) further includes a second shaft-receiving hole (129).

The lengths of the first and the second shafts (134, 136) are equal or greater than widths of the first and second shafts (134, 136); preferably, the lengths of the first and the second shafts (134, 136) are greater than the widths of the first and second shafts (134, 136). As to the material of the first and second shafts (134, 136), preferably both are made from ferromagnetic material. Examples of ferromagnetic material includes steel, steel alloys, iron, and the like. The first and second shafts (134, 136) may also comply with certain standards, such as DIN 3126 ISO 1173 or DIN 7427. To permit a more convenient fit between the shaft-receiving holes (127, 129) of the side cleaning assembly (120), the side cleaning assembly (120) further includes magnetic material in each of the shaft-receiving holes such that a snap-to magnetic fit occurs when the first and second shafts (134, 136) are received in their respective shaft-receiving holes. Also, the handle (140) may have a magnet in its shaft receiving hole (141).

Figure 5A:
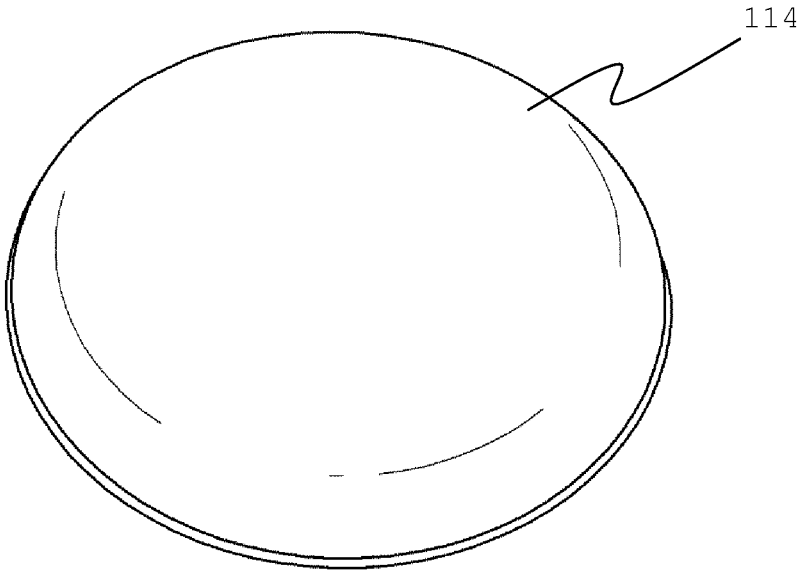
FIGS. 5A and 5B show top and bottom perspective views of the mount of the top cleaning assembly.
Figure 5B:
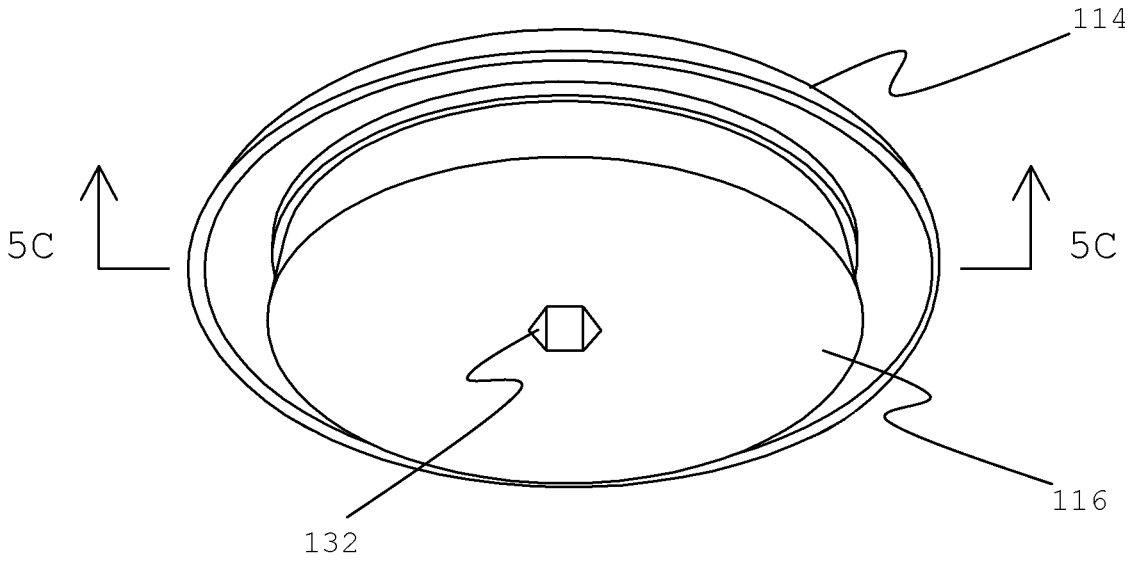
Figure 5C:
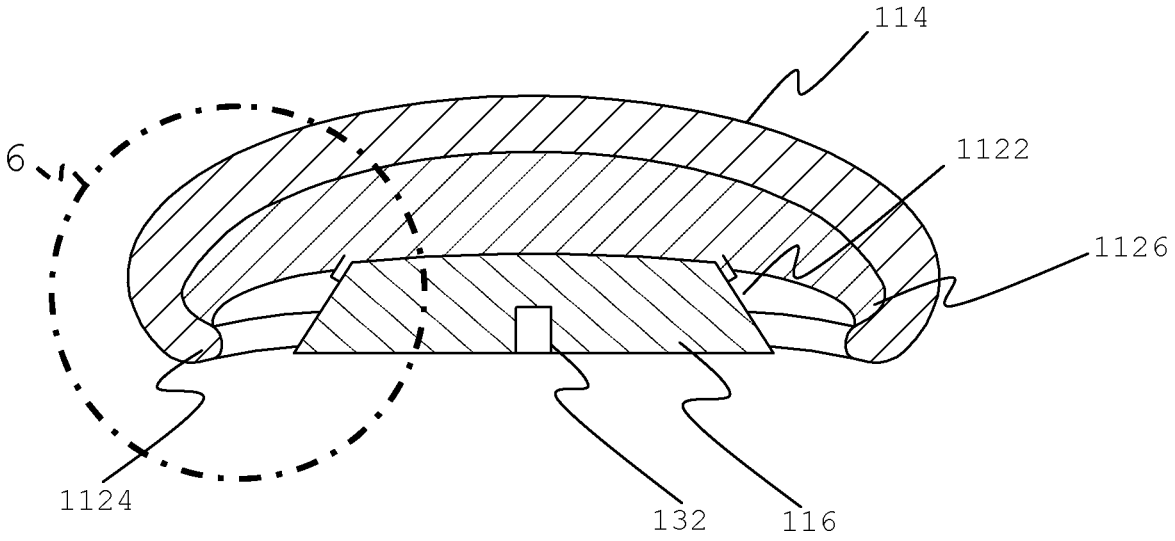
FIG. 5C shows a cross-sectional view of the mount as indicated on FIG. 5B.

FIGS. 5A-B show top and bottom perspective views of the mount (114). As shown in FIG. 5B, a bottom (116) of the mount (114) is substantially circular. Furthermore, the mount (114) of the top cleaning assembly (110) may also be substantially circular as shown in FIG. 5A. The diameters of the bottom (116) of the mount (114) and the mount (114) itself can be substantially the same in one configuration of the versatile cleaning device (100). Alternatively, for other configurations of the versatile cleaning device (100), a diameter of the mount (114) is larger than a diameter of the bottom (116) of the mount (114) as shown in FIGS. 5A-C. Also alternatively, for other configurations of the versatile cleaning device (100), a diameter of the mount (114) is smaller than a diameter of the bottom (116) of the mount (114).

Figure 6A:
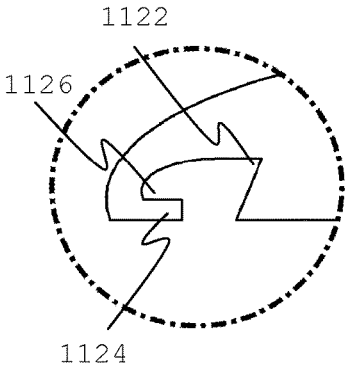
FIGS. 6A-F show cross-sectional views of a portion of the mount as indicated on FIG. 5C.
Figure 6B:
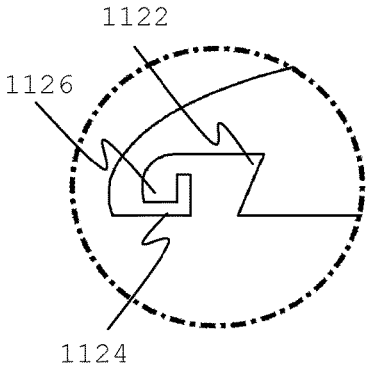
Figure 6C:
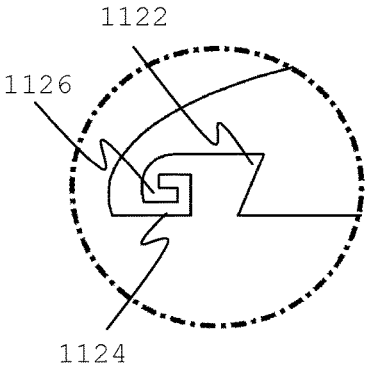
Figure 6D:
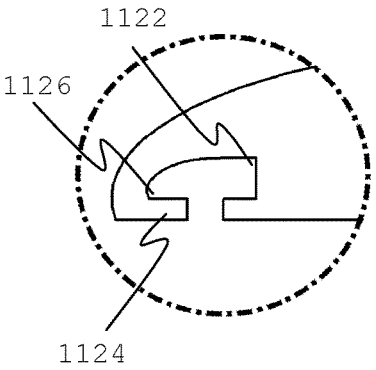
Figure 6E:
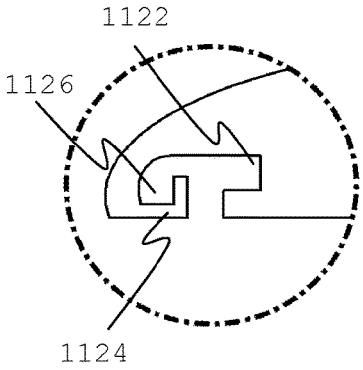
Figure 6F:
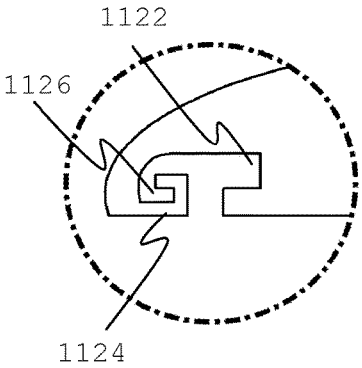

As shown in FIG. 5C, the mount (114) may further include an annular groove (1122). For the annular groove (1122) of the mount (114) shown in FIGS. 6A-C, an inner wall of the annular groove (1122) is tapered toward a center of the mount (114). From a bottom (116) of the mount (114), the taper is angled towards the center of the mount (114) to allow the retaining ring (152) to fit into the annular groove (1122) tightly and securely to prevent the top cleaning means (112) of the removable type from being unintentionally or prematurely dislodged from the top cleaning assembly (110) when the top cleaning assembly (110) is being rotated due in part to the activated electric motor (142). Alternatively, as shown in FIGS. 6D-F, the inner wall of the annular groove (1122) is stepped towards the center of the mount (114). This stepped construction on the bottom (116) of the mount (114) forms the annular groove (1122), which allows the retaining ring (152) to fit therein tightly to secure the top cleaning means (112) of the removable type such that the top cleaning means (112) does not become unintentionally or prematurely dislodged from the top cleaning assembly (110) during cleaning operations. FIGS. 6A-F also show how an edge (1124) of the mount (114) extends at least towards a center. The edge (1124) of the mount (114) may be constructed to form an edge groove (1126). A second retaining ring may be used to further secure the top cleaning means (112) to the top cleaning assembly (110). Here, the second retaining ring is tightly fitted and secured within the edge groove (1126) over a portion of the top cleaning means (112) that is also positioned within the edge groove (1126).

The top cleaning assembly (110) may further include a retaining ring (152) constructed to fit in the annular groove (1122) of the mount (114). The retaining ring (152) has elastic properties that permit the retaining ring (152) to not only be received in the annular groove (1122) but also be tightly retained in the annular groove (1122) and not be easily dislodged therefrom. The elastic properties of the retaining ring (152) are owed to the use of elastic and resilient materials in its construction, the latter of which provides the retaining ring (152) its resilient properties. In terms of the shape of the retaining ring (152), the retaining ring (152) may be constructed to adopt any shape to allow it to be received and tightly retained in the annular groove (1122) such as having a substantially flat surface or a substantially rounded surface.

Figure 7A:
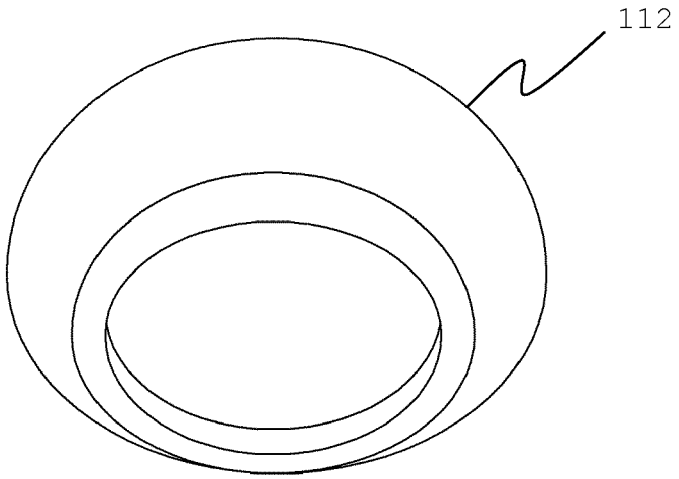
FIGS. 7A and 7B show perspective views of the top cleaning means.
Figure 7B:
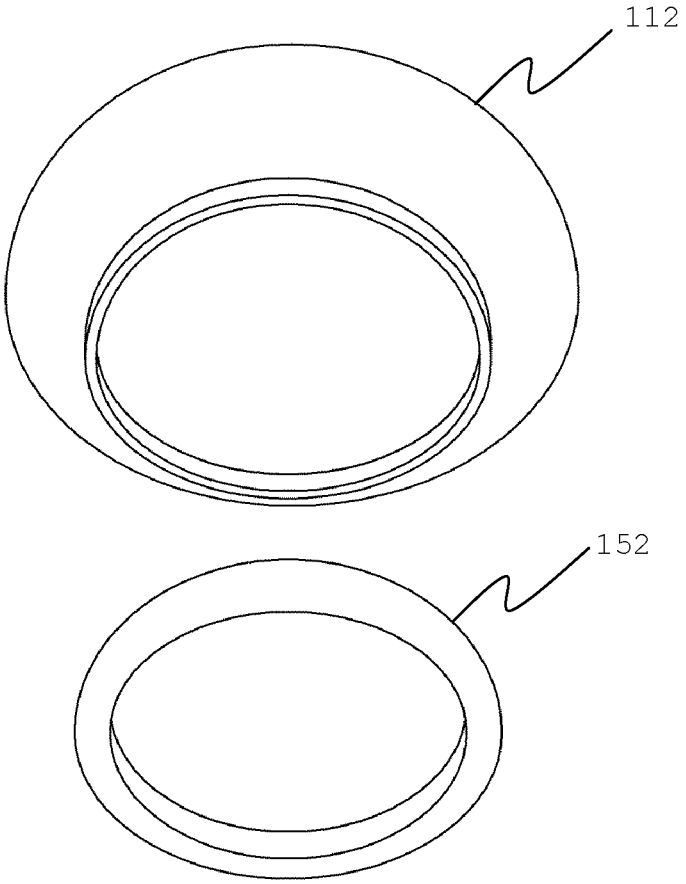
Figure 8A:
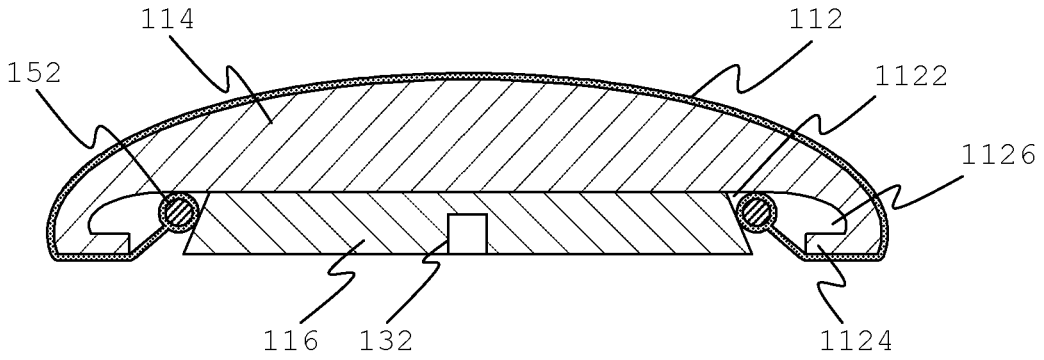
FIGS. 8A-C show cross-sectional views of the top cleaning assembly.
Figure 8B:
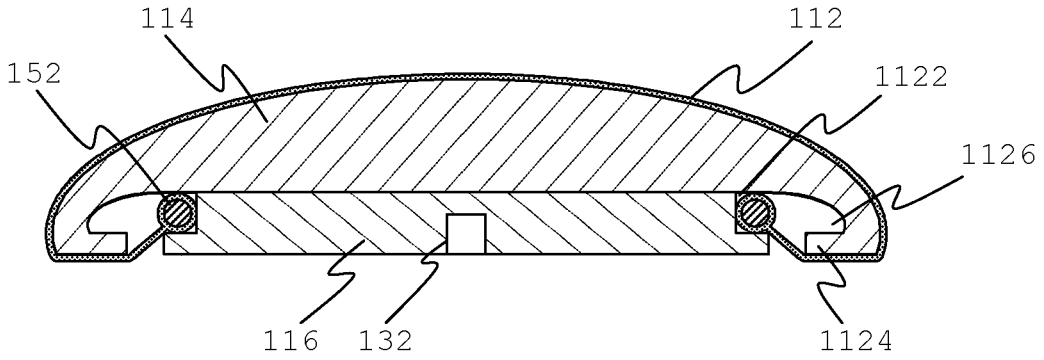

The retaining ring (152) can be sewn to an edge of the top cleaning means (112). Alternatively, as shown in 7A, the edge of the top cleaning means (112) is sewn to form a hem to hold the retaining ring (152) therein. Alternatively, as shown in FIG. 7B, the retaining ring (152) may be independent from the top cleaning means (112), and may be positioned into the annular groove (1122) following positioning of the top cleaning means (112) on the mount (114) where a portion of the top cleaning means (112) is underneath and secured to the mount (114) by the retaining ring (152). Therefore, as shown in FIGS. 8A and 8B, the mount (114) is substantially covered by the top cleaning means (112). Where the retaining ring (152) is part of the top cleaning means (112), the retaining ring (152) is expanded to permit the top cleaning means (112) to substantially cover the mount (114) and then the retaining ring (152) is positioned in the annular groove (1122) of the mount (114), where the resilient property of the retaining ring (152) would close the retaining ring (152) tightly against the annular groove (1122) of the mount (114) that will allow the top cleaning means (112) to be tightly retained on the mount (114), especially when the top cleaning means (112) is being rotated due to the activation of electric motor (142) housed in the handle (140).

Figure 8C:
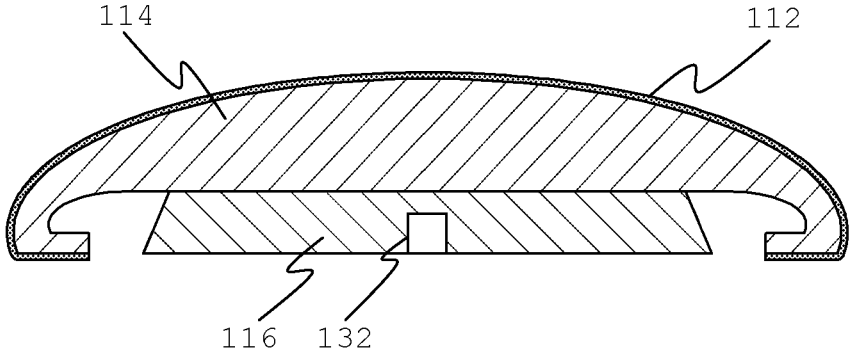
Figure 9A:
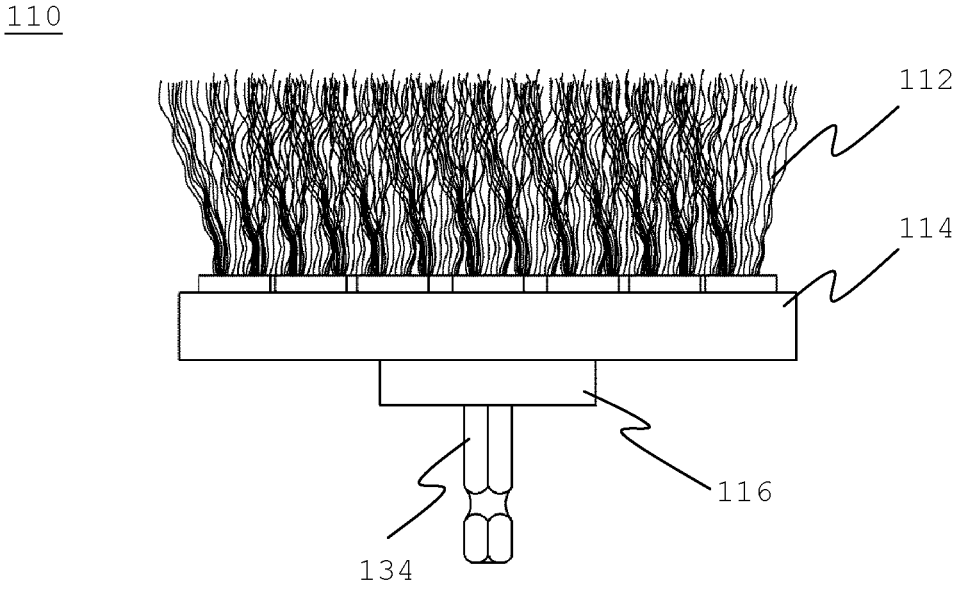
FIGS. 9A and 9B show alternative top cleaning assemblies of the versatile cleaning device.
Figure 9B:
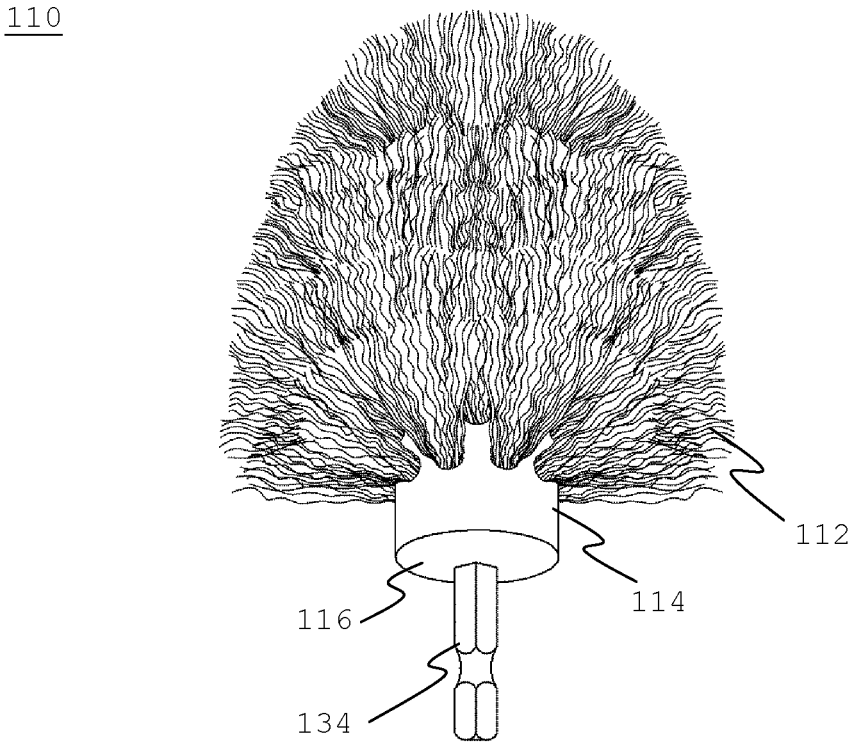

As shown in FIGS. 1A-C, 2, 8A-C, and 9A-B, the top cleaning means (112) can be formed, or be placed, on top of the mount (114). The top cleaning means (112) may be a brush attached on the mount (114) as shown in FIG. 9A; a removable brush substantially covering the mount (114) when placed on the mount (114); a wool fabric, cleaning fabric, or any other material used for cleaning attached on the mount (114) as shown in FIG. 8C; or a removable cover including wool fabric, cleaning fabric, or any other material used for cleaning that substantially covers the mount (114) when placed upon the mount (114) as shown in FIGS. 8A and 8B. The side cleaning means (122) is at least partially on a side of the body (124), but preferably and substantially formed around the sides of the body (124). The side cleaning means (122) may be a brush attached on the body (124); a removable brush configured to substantially cover the body (124); a wool fabric, cleaning fabric, or any other material used for cleaning attached on the body (124); a removable cover including wool fabric, cleaning fabric, or any other material used for cleaning that substantially covers the body (124) when placed thereon. The top cleaning means (112) may be separable from the mount (114) as shown in FIGS. 5A and 5B, or the top cleaning means (112) may be integrated with the mount (114) as shown in FIGS. 9A and 9B. Likewise, the side cleaning means (122) may be integrated with body (124) of the side cleaning assembly (120), or separable from the body (124) of the side cleaning assembly (120). The top cleaning assembly (110) may rotate clockwise or counter-clockwise when the handle (140) is turned on by the user. Preferably, the handle (140) will include a switch (146) that can turn the electric motor (142) on or off and can select speed of the rotation of the top and side cleaning assemblies. The handle (140) may further include a light-emitting diode ("LED") (148) to assist the user in cleaning darker surfaces or in circumstances where the lighting might be lower.

Figure 10A:
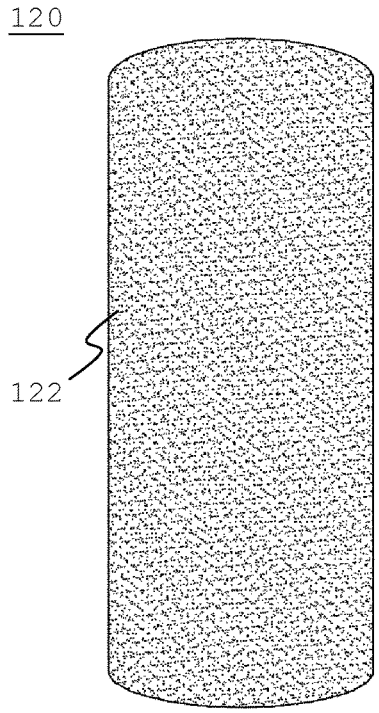
FIGS. 10A-D show side cleaning assemblies of the versatile cleaning device with FIGS. 10A-B showing side views of the side cleaning assembles and FIGS. 10C-D showing cross-sectional views of the side cleaning assembly.
Figure 10B:
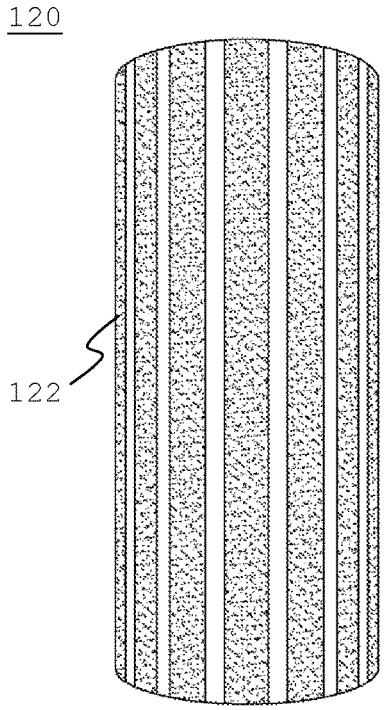
Figure 10C:
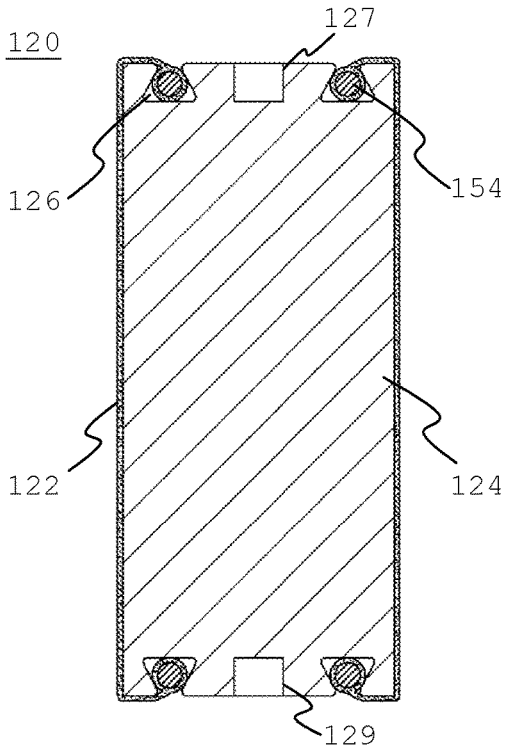
Figure 10D:
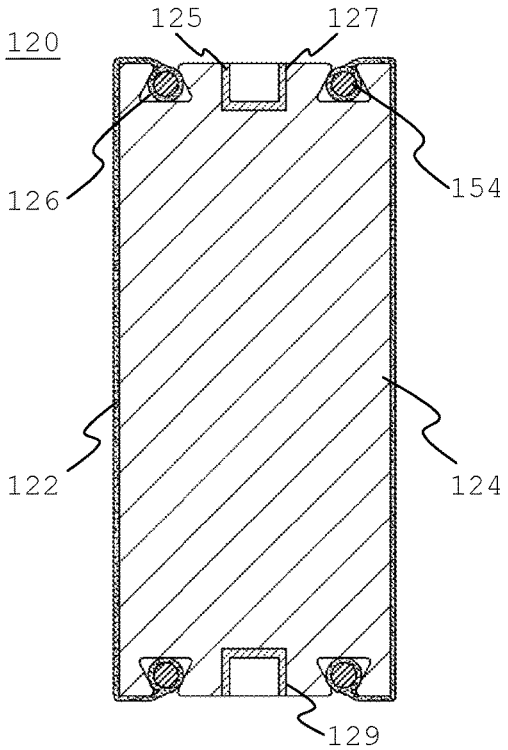
Figure 11A:
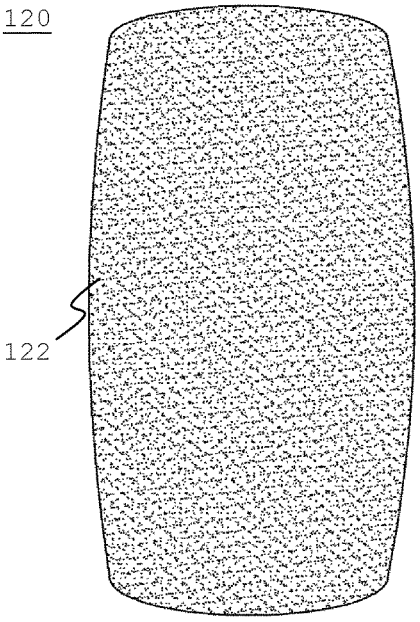
FIGS. 11A-D show side cleaning assemblies of the versatile cleaning device with FIGS. 11A-B showing side views of the side cleaning assembles and FIG. 11C-D showing cross-sectional views of the side cleaning assembly.
Figure 11B:
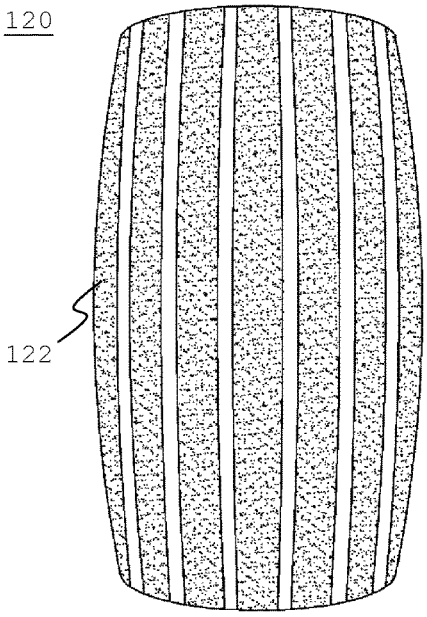

With respect to the side cleaning assembly (120), the body (124) of the side cleaning assembly (120) may be constructed to be substantially cylindrical as shown in FIGS. 10A-D or substantially barrel-shaped as shown in FIGS. 11A-D. The side cleaning means (122) as shown in FIGS. 10A and 11B are wool or fabric material (attached or removably coupled); and the side cleaning means (122) as shown in FIGS. 10B, 11B, and 12A-D are brush material (attached or removably coupled). As stated, the side cleaning means (122) may be directly attached to the body (124) of the side cleaning assembly (120) as described above, or the side cleaning means (122) may exist as a removable element as described above that substantially covers the body (124) of the side cleaning assembly (120). For the latter, as shown in FIGS. 10C, 10D, 11C, and 11D, the body (124) of the side cleaning assembly (120) may include at least one body groove (126) constructed on opposite ends of the body (124), which allows a retaining ring (154) having resilient properties to achieve a proper tight fit therein. Preferably, the body grooves (126) are formed by tapered walls of the body (124) to prevent the retaining ring (154) from dislodging prematurely when the versatile cleaning device (100) is in operation. The side cleaning means (122) may include at least two edges wherein each of the edges may include a retaining ring (154) sewn thereon. Alternatively, the side cleaning means (122) may include at least two edges wherein each of the edges forms a hem that can receive the retaining ring (154) therein. As shown, the user may expand one of the edges of the side cleaning means (122) using the retaining ring (154) to slide it over and substantially cover the body (124) and secure the side cleaning means (122) to the body (124) by placing the portion of the side cleaning means (122) that corresponds to the retaining ring (154) into one of the body grooves (126). The resilient nature of the now-expanded retaining ring (154) would cause the retaining ring (154) to close-in against the wall of the body groove (126) to secure the side cleaning means (122) to the body (124). Alternatively, the side cleaning means (122) without a retaining ring (154) sewn thereon, or within the edge of the retaining ring (154), may still secure the side cleaning means (122) to the body (124) by first substantially covering the body (124) with the side cleaning means (122) and then use a retaining ring (154) to secure the side cleaning means (122) to the body (124), as the set retaining ring (154) pushes the side cleaning means (122) against a wall of the body (124) as shown.

Figure 11C:
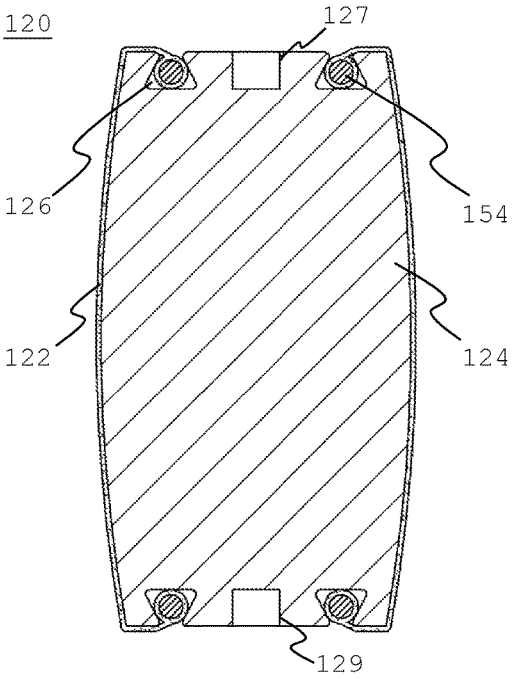

The side cleaning assembly (120) further includes first and second shaft-receiving holes (127, 129) formed by the body (124) of the side cleaning assembly (120) as shown in FIGS. 10C and 11C. The first and second shaft-receiving holes (127, 129) may conform to the ends of the first and second shafts (134, 136) respectively. As shown in FIG. 3, the ends of the first and second shafts (134, 136) may be hexagonal, prismatic, square, or any other polygonal shape. Furthermore, the ends of the first and second shafts (134, 136) may be threaded and/or circular. If the ends of the first and second shafts (134, 136) to be received in the in first and second shaft-receiving holes (127, 129) are threaded, the first and second shaft-receiving holes (127, 129) may be complimentarily threaded as well. The first and second shaft-receiving holes (127, 129) may also receive in the depths and/or sides therein one or more magnetic elements that are magnetic attracted to the ferromagnetic first and second shafts (134, 136) to establish a tighter coupling between the first and second shafts (134, 136) and the first and second shaft-receiving holes (127, 129) respectively when the first and second shafts (134, 136) are respectively inserted into and received by the first and second shaft-receiving holes (127, 129). Additionally, and preferably, first and second shaft-receiving holes (127, 129) are constructed to permit the user to remove the first and second shafts (134, 136) when the versatile cleaning device (100) is not in operation. The fit between first and second shaft-receiving holes (127, 129) and the ends of the first and second shafts (134, 136) may be snap-fit, interlocking fit, or threaded screw-fit, coupled with the magnetic attraction provided by the magnetic elements within the first and second shaft-receiving holes (127, 129).

Alternatively, the walls and floor of the first and second shaft-receiving holes (127, 129) formed by the body (124) of the side cleaning assembly (120) may also include an insert (125) attached therein, the insert including a hole. The hole of the insert is sized to receive the ends of either the first and second shafts (134, 136). The insert (125) may be made out of metal, and the insert may also include magnetic elements therein lining the walls of the insert that forms the hole and/or the floor of insert that lies opposite to an opening of the hole of the insert (125) to further secure the ends of the first and second shafts (134, 136). The insert (125) is constructed to provide additional strength and stability to secure and retain the first and second shafts (134, 136) to the body (124) of the side cleaning assembly (120). Additionally, and preferably, the insert (125) is constructed to permit the user to remove the first and second shafts (134, 136) when the versatile cleaning device (100) is not in operation. The fit between the hole of the insert (125) and the ends of the first and second shafts (134, 136) may be snap-fit, interlocking fit, or threaded screw-fit, along with the magnetic attraction provided by the magnetic elements within the hole of the insert (125) or without the magnetic attraction from the magnetic elements if the fit mechanism is secure and stable enough.

In this embodiment, the top cleaning means (112) may include at least one of animal hair, synthetic hair, regular hair, vegetable fiber, wire, cotton material, wool material, and fabric material. Furthermore, the side cleaning means (122) may include at least one of animal hair, synthetic hair, regular hair, vegetable fiber, wire, cotton material, wool material, and fabric material. For the above, animal hair includes (but is not limited to) goat hair, hog bristle, horse hair, camel hair, ox hair, red sable, skunk or finch hair, squirrel hair, and the like. Also for the above, synthetic hair includes (but is not limited to) carbon fiber, nylon (including those of type 6, 6.6, and 6.12), polyester, peek, polyethylene, polypropylene, polystyrene, PTFE, PVC, acrylic fiber, other plastics, and the like. Further, for the above, vegetable fiber includes (but is not limited to) bass, bassine, piassava, kittool, palmetto, palmyra, rice root, tampico, union fiber, and the like. Further, for the above, wire includes (but is not limited to) the following materials combined or (preferably) singly: aluminum, brass, carbon steel, nickel silver, phosphor bronze, stainless steel, and the like. Any brush bristles included in the top cleaning means (112) and/or side cleaning means (122) that are made from the above listed materials may be thin or thick, and long or short with the brush bristles of differing thickness and lengths divided into different areas of the top cleaning means (112) and/or the side cleaning means (122), so that various parts of the article (e.g. various parts of the shoe including the sole of the shoe) may be cleaned without the need for switching out the top cleaning means (112), the side cleaning means (122), or both, thus lessening the burden/inconvenience of the user to perform such an action.

In another embodiment, a versatile cleaning device (100) for rotatably cleaning a variety of articles and surfaces, the versatile cleaning device (100) includes a top cleaning assembly (110) that includes a top cleaning means (112) and a mount (114); a side cleaning assembly (120) that includes a side cleaning means (122) and a body (124); and a handle (140) that includes an electric motor (142) and a shaft-receiving hole (141). The side cleaning assembly (120) is constructed to couple, directly or indirectly, to the handle (140). The top cleaning assembly (110) is constructed to couple, directly or indirectly, to the side cleaning assembly (120). Furthermore, the top cleaning assembly (110) is constructed to couple, directly or indirectly, to the handle (140). The top cleaning means (112) and the side cleaning means (122) may be the same as those described earlier.

The top cleaning assembly (110) further includes a first fastening means (134). The side cleaning assembly (120) further includes second and third fastening means (127, 136). Here, the handle (140) further includes a fourth fastening means (145). The first fastening means (134) is constructed to couple, directly or indirectly, with the second fastening means (127). The first fastening means (134) is also constructed to couple, directly or indirectly, with the fourth fastening means (145). The third fastening means (136) is constructed to, directly or indirectly, with the fourth fastening means (145). The first fastening means (134) and the third fastening means (136) may include shafts having two ends as described under the standards of DIN 3126 ISO 1173 or DIN 7427. The coupling between the different fastening means here may involve removable coupling which includes (but is not limited to) snap-fit, screw-fit, or interlocking fit. The ends of the first fastening means (136) may be substantially similar or different to one another, likewise with the ends of the third fastening means (136). The ends of the first and third fastening means (134, 136) may be threaded, hexagonal, prismatic, or substantially square-shaped as shown in FIG. 3A-3D. The second and fourth fastening means (127, 145) may be adapters or shafts having openings or holes that are complementary to the first and third fastening means respectively, and thus, are constructed to receive the first and third fastening means. To provide flexibility to the user, the second and the fourth fastening means (127, 145) are constructed to be complementary to the first fastening means (134) to allow the top cleaning means (112) to removably couple with the side cleaning means (122) or the handle (140).

Figure 11D:
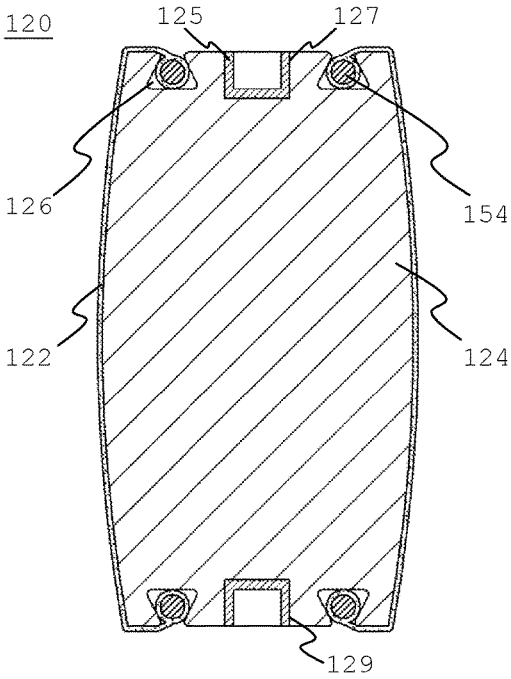

As shown in FIGS. 10C-D and 11C-D, the second fastening means (127, 129) may be formed on top and bottom of the body (124). One example, an alternative to the adapters and shafts as explained earlier, the second fastening means (127, 129) associated with the body (124) of the side cleaning assembly (120), as shown in FIGS. 10C and 11C, can be receiving holes for the first and fourth fastening means (134, 145), so that the orientation of the body (124) can be oriented in whichever way the user prefers. Alternative to this example is that the second fastening means (125) can be an insert (125) as shown in FIGS. 10D and 11D, which performs a similar function. The construction and arrangement of these examples prevent any confusion of which side of the body (124) contains fastening means that are complimentary to the first fastening means (134) or the fourth fastening means (145).

Figure 12A:
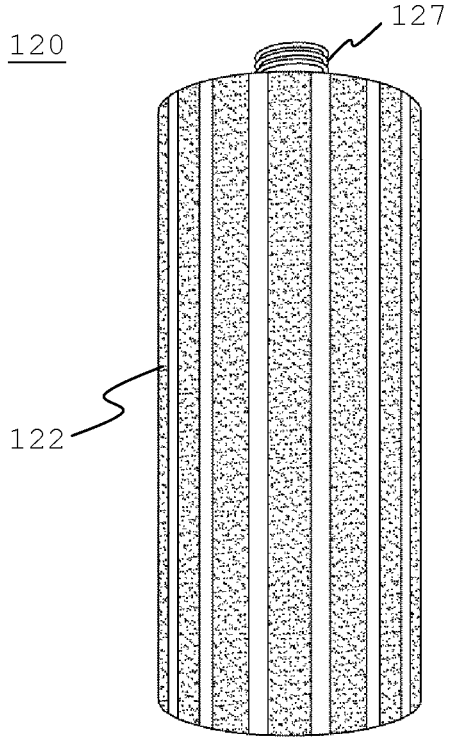
FIGS. 12A-D show side views of side cleaning assemblies of the versatile cleaning device.
Figure 12B:
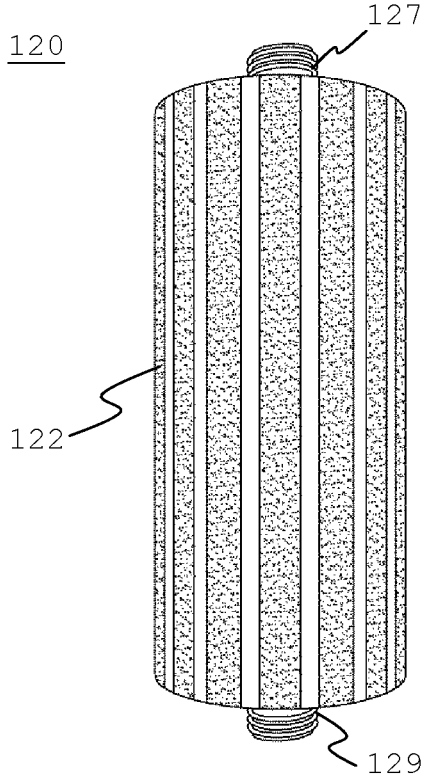
Figure 12C:
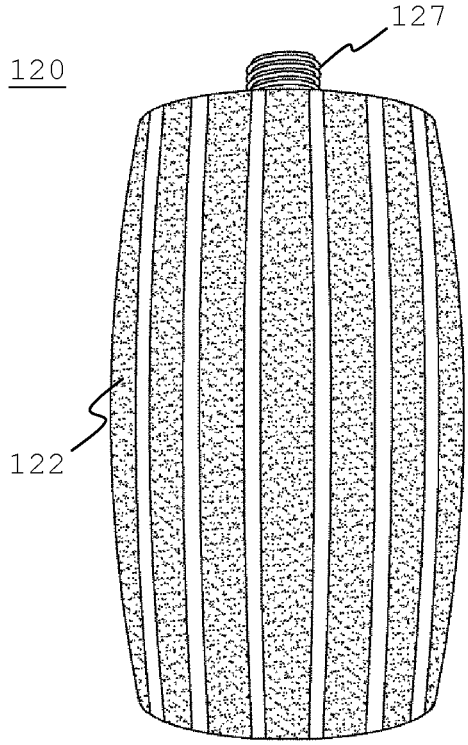
Figure 12D:
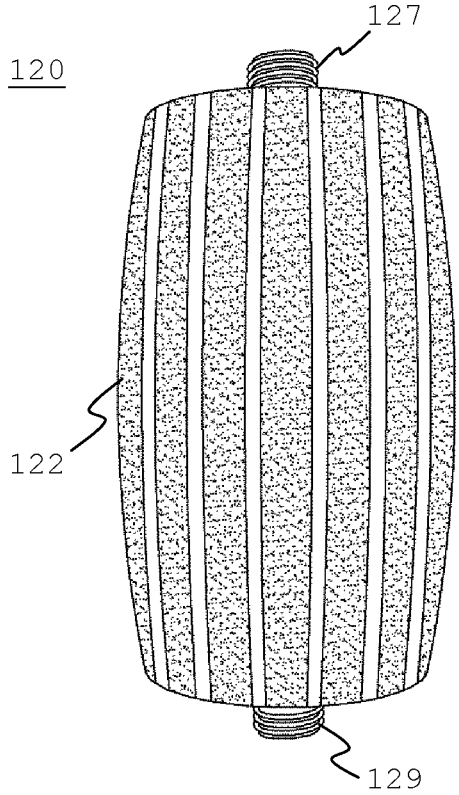

Alternatively, as shown in FIGS. 12A-D, the second coupling means (127), may be threaded couplers located on one or both ends of the body (124) of the side cleaning assembly (120) as shown in FIGS. 12A+C and 12B+D respectively. In FIGS. 12B and 12D, the second coupling means (127, 129) are located on both ends of the body (124) of the side cleaning assembly (120). Alternatively, the second coupling means may be couplers that couple via snap- or interlocking-fits.

Alternatively, the first fastening means (134) may have either a single coupling structure, which is constructed to be coupled with the second fastening means (127, 129) and the fourth fastening means (145), or two coupling structures, one of which is constructed to be coupled with the second fastening means and the other of which is constructed to be coupled with the fourth fastening means (145). Likewise, the second (127, 129), third (136), and fourth fastening means (145) could also be a single structure or multiple structures integrated together.

As described above, a bottom (116) of the mount (114) of the second embodiment is substantially circular. The mount (114) also includes an annular groove (1122). The top cleaning means (112) may also be substantially circular. The top cleaning assembly (110) further includes a retaining ring (152) constructed to fit in the annular groove (1122) of the mount (114). As shown and described earlier, an inner wall of the annular groove (1122) is tapered toward a center of the mount (114).

As in described earlier and shown in FIGS. 5C, 6A-F, in the versatile cleaning device (100) of this embodiment, an edge (1124) of the mount (114) extends at least towards a center. The edge (1124) of the mount (114) may be constructed to form an edge groove (1126). A second retaining ring may be used to further secure the top cleaning means (112) to the top cleaning assembly (110). Here, the second retaining ring is tightly fitted and secured within the edge groove (1126) wherein the second retaining ring covers a portion of the top cleaning means (112) that is also positioned within the edge groove (1126) and presses the portion of the top cleaning means (112) against the wall of the edge groove (1126) to secure the top cleaning means (112) therein. Alternatively, the top cleaning means (112) that has the retaining ring (152) sewn thereon or within a hemmed portion, may have its retaining ring (152) be tightly fitted to the edge groove (1126) instead of the annular groove (1122) to secure the top cleaning means (112) to the mount (114). Multiple options exist for the user to secure the top cleaning means (112) of the removable type to the mount (114) either via the annular groove (1122), the edge groove (1126), or both grooves.

For the top cleaning means (112) of the removable type, the top cleaning means (112) is constructed to at least substantially cover the top of the mount (114). The top cleaning means (112) may include at least one of animal hair, synthetic hair, regular hair, vegetable fiber, wire, cotton material, wool material, and fabric material. For the above, animal hair includes (but is not limited to) goat hair, hog bristle, horse hair, camel hair, ox hair, red sable, skunk or finch hair, squirrel hair, and the like. Also for the above, synthetic hair includes (but is not limited to) carbon fiber, nylon (including those of type 6, 6.6, and 6.12), polyester, peek, polyethylene, polypropylene, polystyrene, PTFE, PVC, acrylic fiber, other plastics, and the like. Further, for the above, vegetable fiber includes (but is not limited to) bass, bassine, piassava, kittool, palmetto, palmyra, rice root, tampico, union fiber, and the like. Further, for the above, wire includes (but is not limited to) the following materials combined or (preferably) singly: aluminum, brass, carbon steel, nickel silver, phosphor bronze, stainless steel, and the like. Any brush bristles included in the top cleaning means (112) and/or side cleaning means (122) that are made from the above listed materials may be thin or thick, and long or short with the brush bristles of differing thickness and lengths divided into different areas of the top cleaning means (112) and/or the side cleaning means (122), so that various parts of the article (e.g. various parts of a shoe including the sole of the shoe) may be cleaned without the need for switching out the top cleaning means (112), the side cleaning means (122), or both, thus lessening the burden/inconvenience of the user to perform such an action.

Figure 13A:
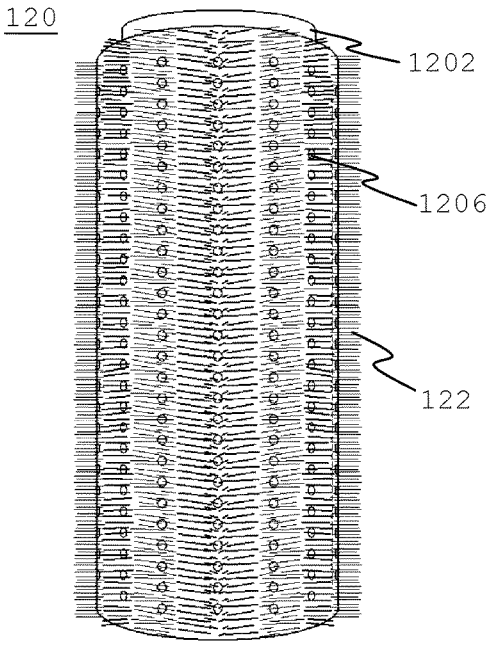
FIGS. 13A-D show various views of the side cleaning assembles of the versatile cleaning device with FIGS. 13A and 13B showing perspective views of the side cleaning assembly, with FIG. 13C showing a cross-sectional view according to 13B, and FIG. 13D showing an opening means of the side cleaning assembly.
Figure 13B:
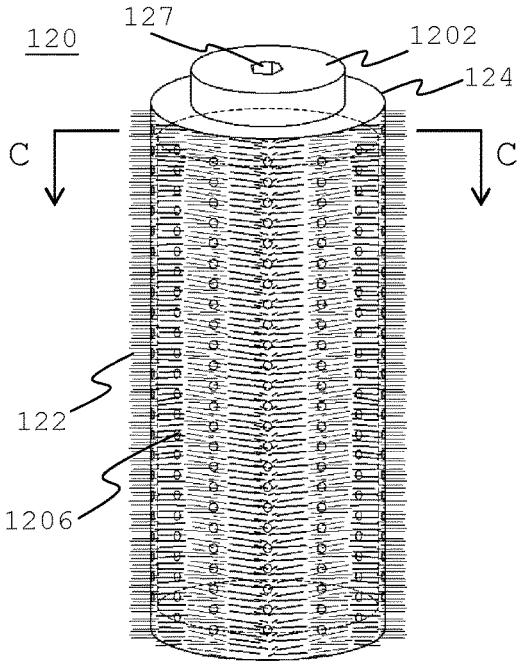
Figure 13C:
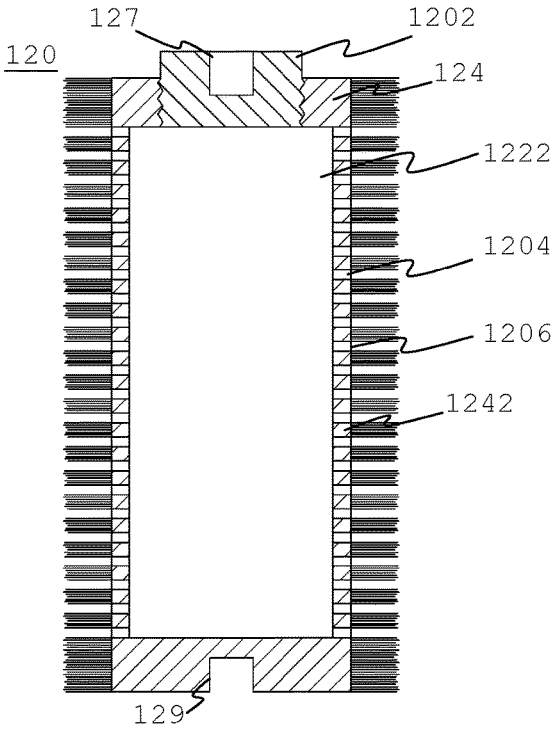
Figure 13D:
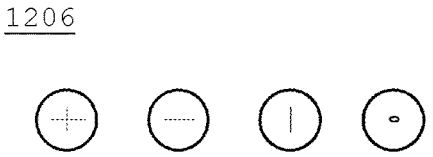

In another embodiment, a versatile cleaning device (100) for rotatably cleaning a variety of articles and surfaces, the versatile cleaning device (100) including a handle (140) that includes an electric motor (142); and a shaft-receiving hole (127); and a side cleaning assembly (120). As shown in FIGS. 13A-C, the side cleaning assembly (120) includes a side cleaning means (122); a body (124); a side wall (1242) between a top and a bottom of the body (124); an internal reservoir (1222) constructed by the side wall (1242) to hold cleaning solution; a coupling cap (1202) constructed to removably couple with the top of the body (124) to provide access to the internal reservoir (1222); a plurality of holes (1204) through the side wall (1242); and an opening means (1206) covering the plurality of holes (1204). As shown in FIG. 13D, the opening means (1206) may be a membrane having an opening hole, a cross-slit, or a slit constructed to permit the cleaning solution to travel from the internal reservoir (1222) to the outside (i.e. traverse the side wall (1242) of the side cleaning assembly (120)) when the versatile cleaning device (100) is turned on and the electric motor (142) is rotating the side cleaning assembly (120) such that the rotation thereof provides sufficient centrifugal force to direct the cleaning solution towards the outside.

Additionally, sufficient pressure is applied to article when being cleaned so that the cross-slit or slit variants of the opening means (1206) open when sufficient pressure applied thereon. When the electric motor (142) is not rotating the side cleaning assembly (120), the opening means (1206) is constructed to substantially prevent the cleaning solution from exiting the internal reservoir (1222) through the plurality of holes (1204). When the electric motor (142) is rotating the side cleaning assembly (120), the opening means (1206) is constructed to substantially allow the cleaning solution to exit from the internal reservoir (1222) through the plurality of holes (1204). The cleaning solution may be soap, bleach, shoe cleaner, shoe cream of any color, or any cleaning or polishing agent known in the art. Furthermore, the side cleaning assembly (120) is constructed to couple, directly or indirectly, to the handle (140).

The coupling cap (1202) may include the second fastening means (127) as shown in FIGS. 13A-B. The second fastening means (127) may be threaded, hex-shaped, or any other opening to which the first fastening means (134) can detachably couple. Additionally, as shown in FIG. 13C, the coupling cap (1202) may be complimentarily threaded to the side cleaning assembly (120) such that the coupling cap (1202) is removably coupled to the side cleaning assembly (120), preferably to the top of the body (124) of the side cleaning assembly (120) as shown in FIGS. 13A-C. Removal of coupling cap (1202) from the top of the body (124) provides access to the internal reservoir (1222) of the side cleaning assembly (120). Providing such access would allow the user to fill or refill the internal reservoir with the cleaning solution of their choice. Furthermore, access to the internal reservoir (1222) would allow the user to clean the internal reservoir (1222) after using the versatile cleaning device (100) to clean an article, or when desiring to switch to another particular type of cleaning solution.

The versatile cleaning device (100) of this embodiment may further include a top cleaning assembly (110). Here, similar to the above embodiments, the top cleaning assembly (110) includes a top cleaning means (112); a mount (114); and a first fastening means (134), wherein the top cleaning assembly (110) is constructed to couple, directly or indirectly, to the side cleaning assembly (120), wherein the top cleaning assembly (110) is constructed to couple, directly or indirectly, to the handle (140). The side cleaning assembly (120), similar to the above embodiments, may further include second and third fastening means (127, 136). Additionally, the handle (140) may further include a fourth fastening means (145). The first fastening means (134) is constructed to couple, directly or indirectly, with the second fastening means (127), wherein the first fastening means (134) is constructed to couple, directly or indirectly, with the fourth fastening means (145), wherein the third fastening means (136) is constructed to, directly or indirectly, with the fourth fastening means (145). Here, when the electric motor (142) is not rotating the side cleaning assembly (120), the opening means (1206) is constructed to substantially prevent the cleaning solution from exiting the internal reservoir (1222) through the plurality of holes (1204), and wherein, when the electric motor (142) is rotating the side cleaning assembly (120), the opening means (1206) is constructed to substantially allow the cleaning solution to exit from the internal reservoir (1222) through the plurality of holes (1204).

Figure 14A:
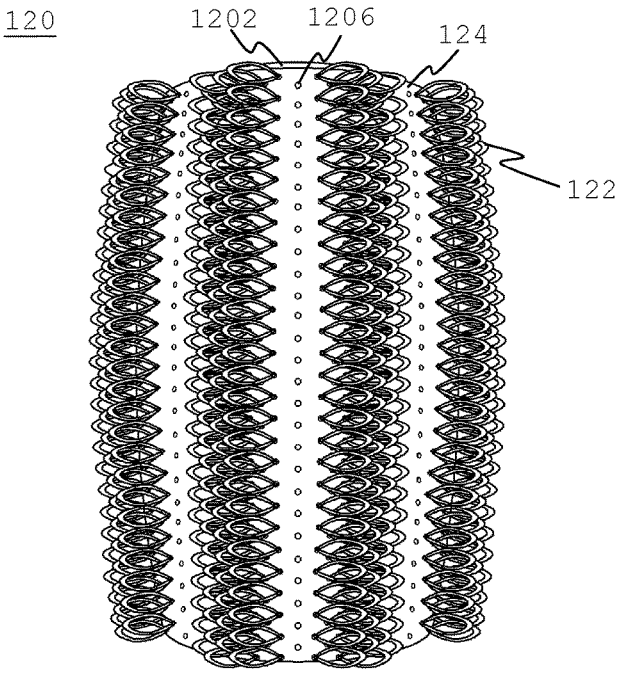
FIGS. 14A-C show side views of the side cleaning assembly of the versatile cleaning device.
Figure 14B:
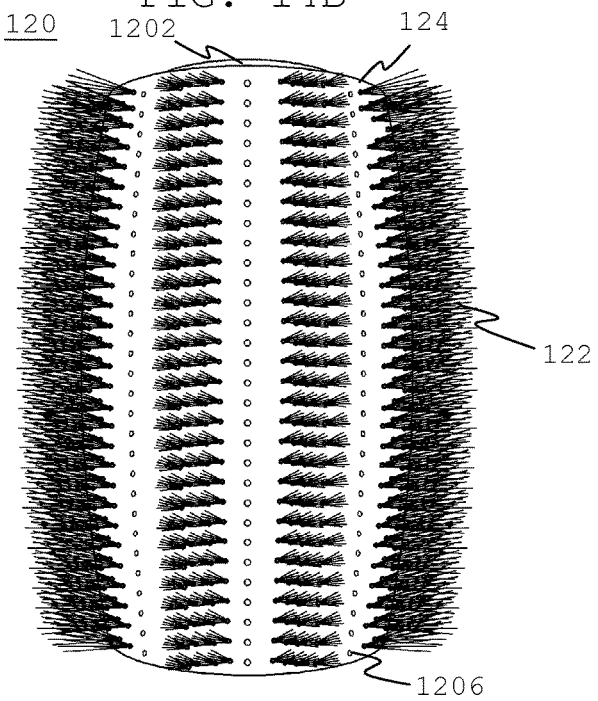
Figure 14C:
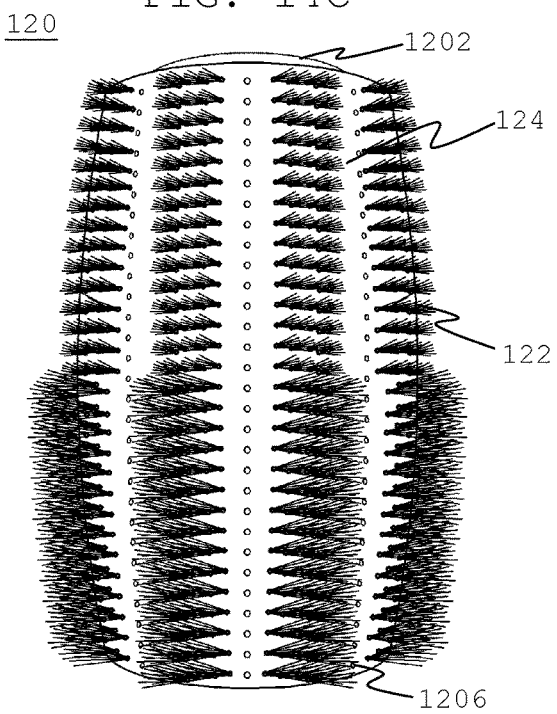

The top cleaning means (112) may include first and second types of brushes. Likewise, the side cleaning means (122) includes first and second types of brushes that are located on the side of the body (124) arranged in vertical rows as shown in FIG. 14B and may additionally be located on the top and bottom of the body (not shown). The first type of brush of the top cleaning means (112) or the side cleaning means (122) may include long bristles and the second type of brush of the top cleaning means (112) or the side cleaning means (122) may include short bristles, or vice versa, as shown in FIGS. 14B and 14C for the side cleaning means (122). Also, the long bristles are constructed to be thick or thin, and the short bristles are constructed to be thick or thin. Alternatively, the top cleaning means (112) and the side cleaning means (122) may include wool, cotton, or cloth cleaning fabric, the latter of which is shown in FIG. 14A, that may have uniform (or non-uniform) distribution and/or uniform (or non-uniform) thickness depending on the shape or profile of the article that the user desires to clean.

As shown in FIG. 14B for the side cleaning assembly (120), the first type of brush of the side cleaning means (122) may be organized in a row. Likewise, the second type of brush of the side cleaning means (122) may be similarly organized in a row. The rows of the first type of brush and the second type of brush may alternate one after the other, or, as shown, there may be two rows of the first type of brush followed by a row or two rows of the second type of brush, or vice versa. Alternatively, the first and second types of brushes of the side cleaning means may be in the same row as shown in FIG. 14C. As shown, there may be a section having the first type of brush followed by another section of the row having the second type of brush, or the first type of brush is intermingled with the second type of brush (not shown). The rows of brushes may be arranged vertically as shown in FIGS. 14B-C, or the rows of brushes may be arranged horizontally (not shown).

While the invention has been shown and described with reference to different embodiments thereof, it will be appreciated by those skilled in the art that variations in form, detail, compositions and operation may be made without departing from the spirit and scope of the invention as defined by accompanying claims.

What is claimed is:

1. A versatile cleaning device for rotatably cleaning a variety of articles and surfaces by being attached to a handle having an electric motor, the versatile cleaning device comprising:

a top cleaning assembly that includes a top cleaning means and a mount;

a first shaft constructed to be fixedly or removably coupled to the top cleaning assembly;

a side cleaning assembly that includes a side cleaning means, a body, and a first shaft receiving hole; and a second shaft constructed to be fixedly or removably coupled to the side cleaning assembly, wherein the second shaft is constructed to be attached to the handle for electrically rotating the versatile cleaning device, wherein portions of the first and second shafts are multi-sided, wherein a cross-section of the first shaft and a cross-section of the second shaft are substantially the same, wherein the first shaft is constructed to be attached to the handle for electrically rotating the versatile cleaning device, wherein the second shaft is removably coupled to the side cleaning assembly, and wherein the side cleaning assembly further includes a second shaft-receiving hole.

2. The versatile cleaning device of claim 1, wherein the cross-sections of the portions of the first and second shafts are substantially hexagonal, and wherein the first shaft is fixedly coupled to the top cleaning assembly.

3. The versatile cleaning device of claim 1, wherein a bottom of the mount is substantially circular, wherein the mount includes an annular groove, wherein the top cleaning means is substantially circular, and wherein the top cleaning assembly further includes a retaining ring constructed to fit in the annular groove of the mount.

4. The versatile cleaning device of claim 3, wherein the retaining ring is sewn to an edge of the top cleaning means.

5. The versatile cleaning device of claim 3, wherein an inner wall of the annular groove is tapered toward a center of the mount.

6. The versatile cleaning device of claim 1, wherein a top of the mount is substantially circular, and wherein the top cleaning means is constructed to cover the top of the mount.

7. The versatile cleaning device of the claim 1, wherein the top cleaning means includes at least one of animal hair, regular hair, synthetic hair, vegetable fiber, wire, cotton material, wool material, and fabric material, and wherein the side cleaning means includes at least one of animal hair, regular hair, synthetic hair, vegetable fiber, wire, cotton material, wool material, and fabric material.

8. The versatile cleaning device of claim 1, wherein the body of the side cleaning assembly is substantially cylindrical or substantially barrel-shaped.

9. The versatile cleaning device of claim 1, wherein the body includes a groove that is sized to accept a retaining ring in a snug fit, and wherein the retaining ring is constructed to removably couple with the groove.

10. The versatile cleaning device of claim 9, wherein the side cleaning means includes the retaining ring, wherein the retaining ring is sewn on or hemmed into the side cleaning means, wherein the retaining ring is resilient, wherein the retaining ring includes first and second retaining rings, wherein the groove includes first and second grooves, wherein the body includes first and second ends, wherein the first groove is constructed in the first end and the second groove is constructed on the second end, wherein the first and second retaining rings are removably coupled to the first and second grooves respectively in snug fits, or the second and first retaining rings are removably coupled to the first and second grooves respectively in snug fits.

11. The versatile cleaning device of claim 1, wherein the top cleaning assembly further includes a groove that is sized to accept a retaining ring in a snug fit, and wherein the retaining ring is constructed to removably couple with the groove.

12. The versatile cleaning device of claim 11, wherein the top cleaning means include the retaining ring, wherein the retaining ring is sewn on or hemmed into the top cleaning means, and wherein the retaining ring is resilient.

13. A versatile cleaning device for rotatably cleaning a variety of articles and surfaces, the versatile cleaning device comprising:

a top cleaning assembly that includes a top cleaning means a mount, and a first fastening means;

a side cleaning assembly that includes a side cleaning means, a body, a second fastening means, and a third fastening means; and a handle that includes an electric motor, a shaft-receiving hole, and a fourth fastening means;

wherein the side cleaning assembly is constructed to couple, directly or indirectly, to the handle, wherein the top cleaning assembly is constructed to couple, directly or indirectly, to the side cleaning assembly, wherein the top cleaning assembly is constructed to couple, directly or indirectly, to the handle, wherein the first fastening means is constructed to couple, directly or indirectly, with the second fastening means, wherein the first fastening means is constructed to couple, directly or indirectly, with the fourth fastening means, and wherein the third fastening means is constructed to, directly or indirectly, with the fourth fastening means, wherein a bottom of the mount is substantially circular, wherein the mount includes an annular groove, wherein the top cleaning means is substantially circular, wherein the top cleaning assembly further includes a retaining ring constructed to fit in the annular groove of the mount, wherein an inner wall of the annular groove is tapered toward a center of the mount, and wherein an edge of the mount is extended toward a center.

14. The versatile cleaning device of claim 13, wherein the second fastening means and the third fastening means are formed on top and bottom of the body, and wherein the second fastening means and the third fastening means have substantially the same fastening structure such that either the second fastening means or the third fastening means can be coupled with the first fastening means or the fourth fastening means.

15. The versatile cleaning device of claim 13, wherein the first fastening means have either a single coupling structure, which is constructed to be coupled with the second fastening means and the fourth fastening means, or two coupling structures, one of which is constructed to be coupled with the second fastening means and the other of which is constructed to be coupled with the fourth fastening means.

16. The versatile cleaning device of claim 13, wherein the top cleaning means includes at least one of animal hair, regular hair, synthetic hair, vegetable fiber, wire, cotton material, wool material, and fabric material, and wherein the side cleaning means includes at least one of animal hair, regular hair, synthetic hair, vegetable fiber, wire, cotton material, wool material, and fabric material.

17. A versatile cleaning device for rotatably cleaning a variety of articles and surfaces, the versatile cleaning device comprising:

a handle that includes an electric motor and a shaft-receiving hole; and a side cleaning assembly that includes:

a side cleaning means;

a body;

a side wall between a top and a bottom of the body;

an internal reservoir constructed by the side wall to hold cleaning solution;

a coupling cap constructed to removably couple with the top of the body to provide access to the internal reservoir;

a plurality of holes through the side wall; and an opening means covering the plurality of holes, wherein the side cleaning assembly is constructed to couple, directly or indirectly, to the handle, wherein the coupling cap includes a fastening means, wherein, when the side cleaning assembly is not rotating, the opening means is constructed to substantially prevent the cleaning solution from exiting the internal reservoir through the plurality of holes, wherein, when the side cleaning assembly is rotating, the opening means is constructed to substantially allow the cleaning solution to exit from the internal reservoir through the plurality of holes, and wherein the side cleaning means includes at least one of animal hair, regular hair, synthetic hair, vegetable fiber, wire, cotton material, wool material, and fabric material.

18. The versatile cleaning device of claim 17, further comprising:

a top cleaning assembly including:

a top cleaning means;

a mount; and a first fastening means, wherein the top cleaning assembly is constructed to couple, directly or indirectly, to the side cleaning assembly, wherein the top cleaning assembly is constructed to couple, directly or indirectly, to the handle, wherein the side cleaning assembly further includes second and third fastening means, wherein the second fastening means is comprised of the fastening means of the coupling cap, wherein the handle further includes a fourth fastening means, wherein the first fastening means is constructed to couple, directly or indirectly, with the second fastening means, wherein the first fastening means is constructed to couple, directly or indirectly, with the fourth fastening means, wherein the third fastening means is constructed to, directly or indirectly, with the fourth fastening means.

19. The versatile cleaning device of claim 18, wherein the top cleaning means includes first and second types of brushes, wherein the first type of brush includes long bristles, wherein the second type of brush includes short bristles, wherein the long bristles are constructed to be thick or thin, and wherein the short bristles are constructed to be thick or thin.

20. The versatile cleaning device of claim 17, wherein the side cleaning means includes first and second types of brushes, wherein the first type of brush includes long bristles, wherein the second type of brush includes short bristles, wherein the long bristles are constructed to be thick or thin, and wherein the short bristles are constructed to be thick or thin.

* * * * *